US006910913B1

(12) United States Patent
Satern

(10) Patent No.: US 6,910,913 B1
(45) Date of Patent: Jun. 28, 2005

(54) MULTI-POLE ELECTRICAL CONNECTOR

(76) Inventor: Mark A. Satern, 502 W. Port Royal La., Phoenix, AZ (US) 85023

( * ) Notice: Subject to any disclaimer, the term of this patent is extended or adjusted under 35 U.S.C. 154(b) by 0 days.

(21) Appl. No.: 10/697,223

(22) Filed: Oct. 30, 2003

Related U.S. Application Data

(60) Provisional application No. 60/422,817, filed on Oct. 31, 2002.

(51) Int. Cl.[7] ..... H01R 11/20
(52) U.S. Cl. ..... 439/439
(58) Field of Search ..... 439/439, 441, 439/721, 723, 724, 440

(56) References Cited

U.S. PATENT DOCUMENTS

| | | | | |
|---|---|---|---|---|
| 2,162,864 A | | 6/1939 | Rugg et al. | |
| 3,470,421 A | * | 9/1969 | Shore et al. | 361/826 |
| 3,848,224 A | | 11/1974 | Olivero | |
| 4,165,443 A | | 8/1979 | Figart et al. | |
| 4,210,772 A | | 7/1980 | Magana et al. | |
| 4,272,689 A | | 6/1981 | Crosby et al. | |
| 4,627,675 A | * | 12/1986 | Taylor et al. | 439/92 |
| 4,820,197 A | * | 4/1989 | Stumpff et al. | 439/535 |
| 4,918,258 A | | 4/1990 | Ayer | |
| 5,415,564 A | | 5/1995 | Winter et al. | |
| 6,156,971 A | | 12/2000 | May | |
| 6,394,857 B1 | | 5/2002 | Crochet | |

* cited by examiner

*Primary Examiner*—Phuong Dinh
(74) *Attorney, Agent, or Firm*—Cahill, von Hellens & Glazer, P.L.C.

(57) ABSTRACT

A multi-pole electrical connector is provided with a plurality of electrical busses each arranged to receive a plurality of conductors. The busses are each provided with a plurality of conductor wells to receive and grasp an electrical conductor inserted therein. The opposing walls of the buss are spring loaded to grasp the conductor and a plurality of locking tabs are formed in the individual conductor wells for contacting and grasping the conductor to prevent its inadvertent withdrawal from the well.

8 Claims, 3 Drawing Sheets

MULTI-POLE ELECTRICAL CONNECTOR

CROSS REFERENCE TO RELATED APPLICATION

The present application relates to subject matter described in and claims priority to a provisional application entitled "ZIPBOX WIRE CONNECTING SYSTEM" assigned Ser. No. 60/422,817 and assigned a filing date of Oct. 31, 2002 and describing an invention made by the present inventor.

FIELD OF THE INVENTION

The present invention relates to electrical connectors, and more particularly to electrical connectors for providing connection between multi-pole circuits in junction boxes.

BACKGROUND OF THE INVENTION

The prior art technique, utilized in residential, commercial and industrial applications, is to provide electrical connections between respective pole conductors at junction boxes with individual single pole connectors. For example, a typical domestic junction box will include several wire nuts joining individual electrical conductors. This bundle of wires and wire nuts is then pushed or folded and forced into the junction box. To perform this connection technique, the stripped ends of wires to be joined are placed side-by-side and the ends are twisted together. The twisted tips are then trimmed evenly and a wire nut is threaded over the trimmed tips. The wire nut is then screwed onto the bared and trimmed ends and the joined wires are forced back into the junction box. The connections made in this manner can become dislodged when the completed wire nut connections and wires are jostled as they are being folded, pressed and forced in the junction box. A broken connection may occur within the confines of the interior of the wire nut which broken connection will not be obvious. Other connectors have been suggested in the prior art for joining individual wires of a common pole to thus replace the wire nut. However, each such prior art device requires the same manipulation of connecting each pole and subsequently replacing the connected pole with wire connector back into the junction box. This procedure is repeated for each such pole. Other types of single pole connectors, such as "plug in" type connectors, are sometimes used in place of wire nuts; however, all such prior art connection devices are dedicated to connecting one pole of a circuit with each such connector. That is, they are all single-pole connectors. If the junction box contains more than just single positive, neutral, and ground poles (particularly in such applications including dimmer switches or ground fault indicator outlets) a more complex array of connectors, connections, wire nuts and the like are required. This array of wiring with multiple connectors results in a bulky array of conductors and devices that must be pressured into the junction box creating further mechanical stress on the individual connections with the possibility of faulty connections or failures.

OBJECTS OF THE INVENTION

It is therefore an object of the present invention to provide a single electrical connector device which conveniently connects all conductors of a particular polarity to the circuit as required and also incorporates all poles of a circuit within a single device.

It is another object of the present invention to provide a connector that can be utilized to replace the multiple individual single-pole connector devices previously connecting the individual pole conductors of a system with a single multi-pole connector.

It is still another object of the present invention to provide an electrical connector that can connect individual conductors in a locked position and that can be unlocked for removal of the conductor from the connector.

It is another object of the present invention to provide an electrical connector for joining multiple poles or conductors all within a single connector in a convenient and compact package.

It is still another object of the present invention to provide an electrical connector the provides an orderly and compact device for joining multiple poles within a single connector.

SUMMARY OF THE INVENTION

The present invention comprises a housing containing a plurality of electrical busses. The busses incorporate conductor wells for receiving bared ends of electrical conductors. As used herein, electrical conductors means electrical wires of the type used in domestic and industrial wiring; the conductors may be solid or stranded wires and are connected to each other injunction boxes. The wires are insulated, but the ends thereof are stripped of insulation to expose the bare metal wire which is then used to make the electrical connection. The busses are each arranged to receive all of the conductors in corresponding conductor wells for a given pole of the system. In the embodiment chosen for illustration, a three pole system is provided within an enclosure housing three busses each adapted to receive conductors in conductor wells. The device can be sized smaller than an equivalent number of wire nuts required to connect the same number of conductors so that the device will fit within a standard electrical junction box. The individual conductors are grasped within the corresponding conductor well by spring pressure exerted by a buss and arc releasably locked into position. Since all poles are thus contained within one connector device, an installer can make all connections without the device leaving his hand until all the connections are complete.

BRIEF DESCRIPTION OF THE DRAWINGS

The present invention may more readily be described by reference to the accompanying drawings in which.

DETAILED DESCRIPTION OF THE INVENTION

Figure 1:
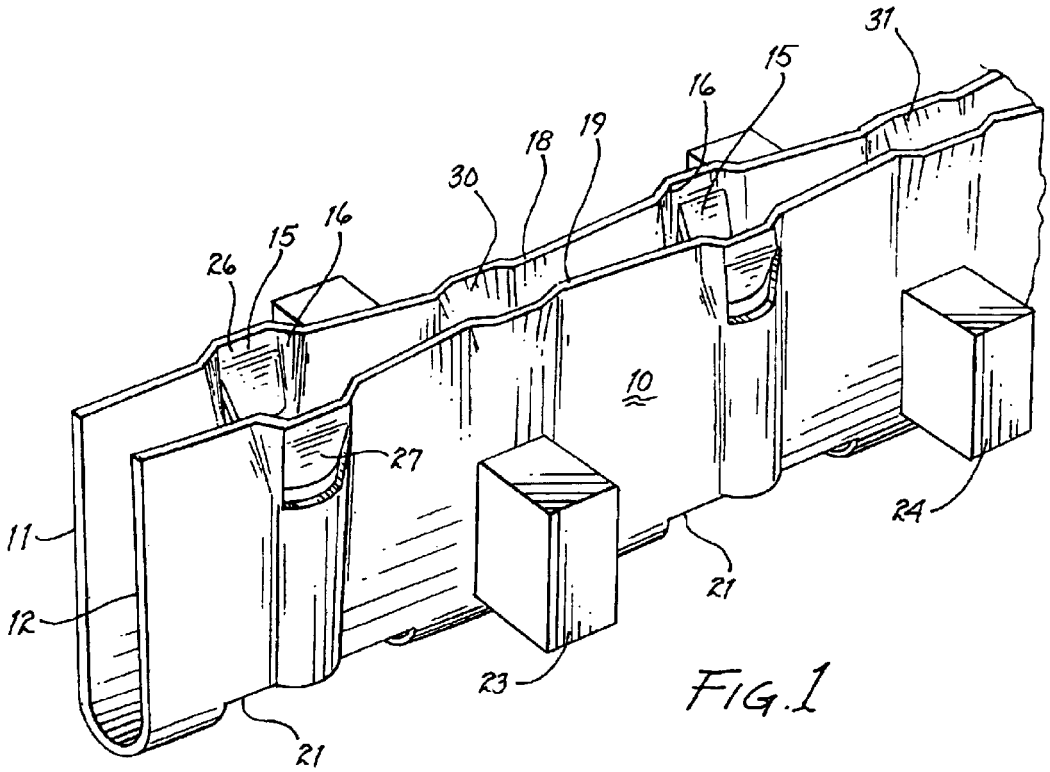
FIG. 1 is a perspective view of a buss incorporated in the connector of the present invention.

Referring now to FIG. 1, a single electrical buss is shown for use in the device of the present invention. The buss 10 is formed of a sheet of conductive material, such as a suitable brass alloy, and is a U-shaped to provide opposing walls 11 and 12 having conductor wells 15 formed therebetween. In the embodiment shown in FIG. 1, the buss is formed of a single U-shaped member; however, some applications may incorporate a pair of opposing wall members formed of separate sheets of conductive material. The top of the wells 15 terminate at the upper edges 18 and 19 of the opposing walls 11 and 12, and are formed to provide a generally cylindrical receptacle for the receipt of an electrical conductor therebetween. The upper edges 18 and 19 of the buss 10 adjacent to the conductor well 15 are formed into with a funnel shape, or are flared, to facilitate the receipt of a conductor and to guide the conductor into the conductor well 15. The space between the opposing walls 11 and 12 of the buss is exaggerated in FIG. 1 for purposes of discussion; however, in practice, the two walls are positioned closely to provide a gripping action upon any conductor that is inserted into a corresponding conductor well. In the embodiment shown in FIG. 1, the buss 10 includes a plurality of cutouts or notches 21 along the bottom of the buss to facilitate the flexure of the conductor walls and permit the buss to firmly contact and grip any conductor inserted into a corresponding conductor well. The buss is supported in position within a housing (to be described) which includes a plurality of buttresses 23 and 24 that contact the respective opposing walls to maintain the walls in position and provide opposing forces to the respective opposing walls when the latter are forced apart by the insertion of a conductor into a respective conductor well. The conductor wells are generally cylindrical and extend the entire depth of the buss. As conductors are inserted into the respective conductor wells, the flared or funnel shaped upper portions 16 of the well receive and guide the bare wire during its insertion into the well. A lock formed of dual and opposed locking tabs 26 and 27 contact and engage the surface of the inserted conductor to prevent the conductor's unintended withdrawal from the conductor well.

To provide a means to release the grip of the bus upon the inserted conductors and to move the locking tabs away from the conductor, release ports 30 and 31 are provided to receive a tool, such as the spade tip of a screwdriver, that will temporarily force the opposing walls of the bus apart to release the grip of the bus on the conductors and release the locking tab from engagement with the surfaces of the conductors.

Figure 2:
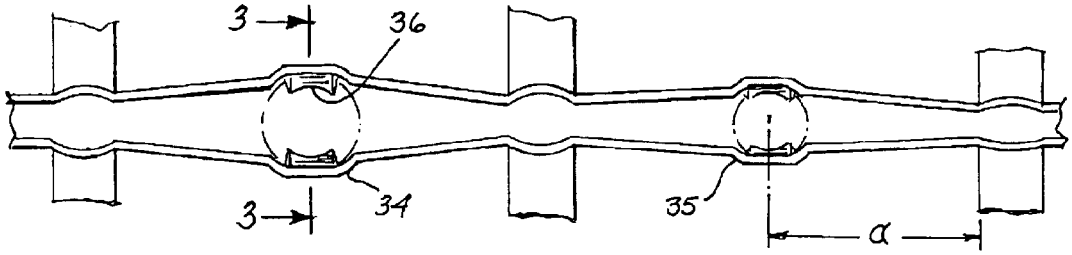
FIG. 2 is a top view of a portion of the buss of FIG. 1.
Figure 3:
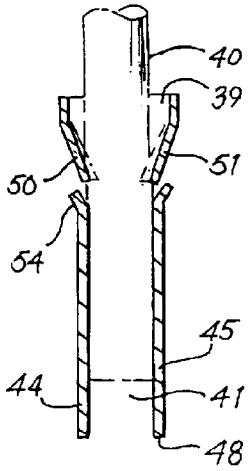
FIG. 3 is a cross-sectional view of a portion of FIG. 2 taken along line 3—3.
Figure 4:
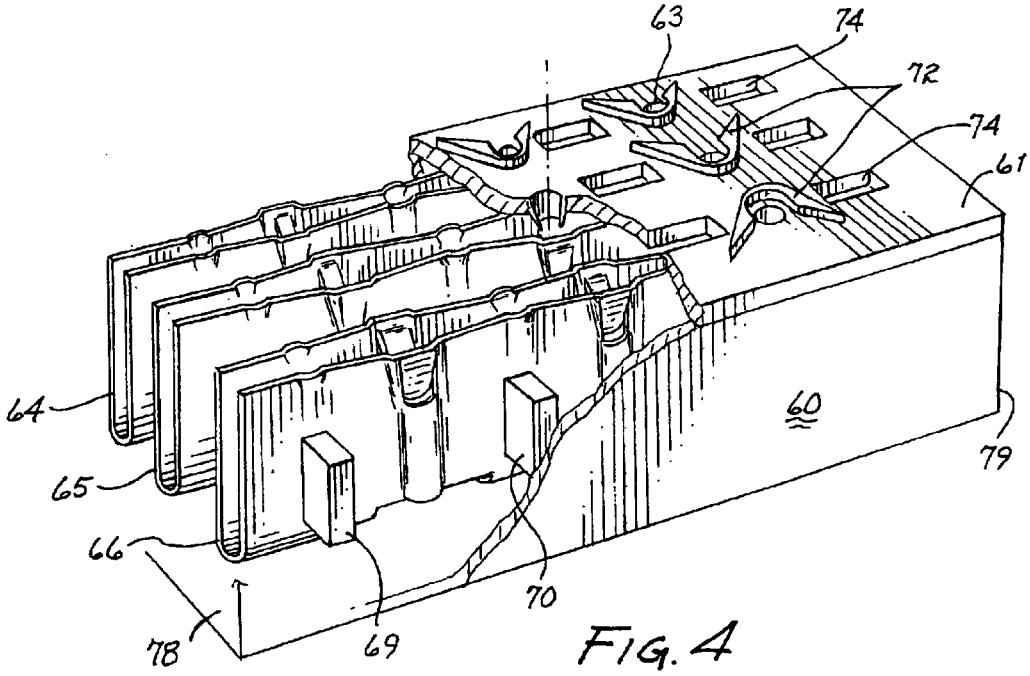
FIG. 4 is a perspective view, partly in section, of a multi-pole electrical connector constructed in accordance with the teachings of the present invention.
Figure 5:
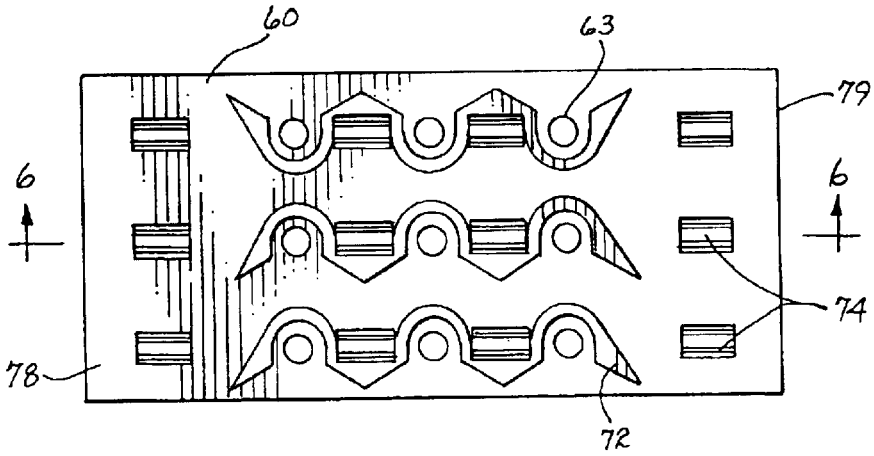
FIG. 5 is a top view of the electrical connector of FIG. 4.
Figure 6:
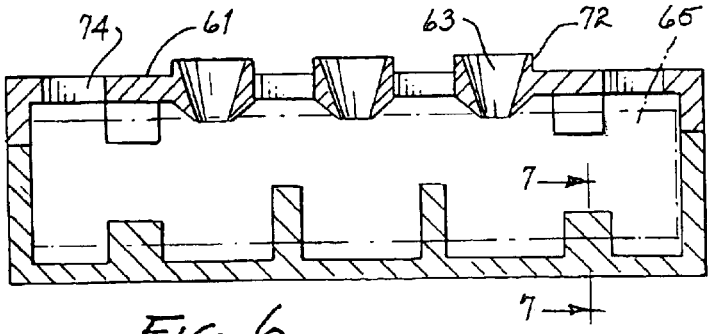
FIG. 6 is a cross-sectional view of FIG. 5 along line 6—6.
Figure 7:
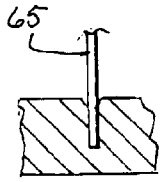
FIG. 7 is a partial cross-sectional view taken along line 7—7 of FIG. 6.
Figure 9:
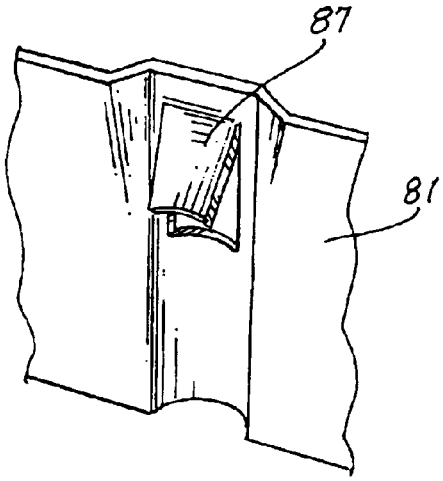
FIG. 9 is an enlarged portion of the buss of FIG. 1 useful for the description of the invention.

Referring to FIG. 2, it may be seen that the respective conductor wells 34 and 35 can accommodate different size conductors. The force exerted by the flexure of the opposing bus walls firmly grips the conductor throughout its length within the corresponding conductor well. Further, it may be seen that the locking tips engage the surface of the corresponding conductor to prevent the inadvertent removal of the conductor from the well. The locking tips 36 can be arcuate as shown in FIG. 2, or may be formed flat with corners bent inward into the conductor well to "bite" into the conductor surface. A cross-section of FIG. 2 is shown in FIG. 3 wherein it may seen that the well entry 39 guides the conductor 40 into the conductor well 41 while the opposing walls 44 and 45 of the bus grip the conductor along its length within the conductor well. The conductor 40 as shown in FIG. 3 is partially inserted into the conductor well; it will be understood that the conductor will normally extend into the conductor well past the bottom edge 48 of the well. The locking tabs 50 and 51 formed in the buss are formed to blend into the mouth of the conductor well entry. The locking tabs are shown in broken lines as they would appear in a rest position before the entry of a conductor into the conductor well. The conductor forces the locking tabs outward and causes the tips of the tabs to engage the surface of the conductor and prevent the latter's unintended withdrawal from the conductor well.

It may be noted that the flared or funnel-shaped entry into the respective conductor wells guides the conductor into the corresponding conductor well; as the conductor extends further into the well, it is surrounded on two sides by the corresponding opposing walls of the buss to thereby envelop the conductor's full circumference. The contact area with the conductor is thus increased to lower contact resistance between the buss and the conductor. It is also important to note that both sides of the conductor well are spring loaded; that is, the gripping force of the buss upon the conductor is supplied by both opposing walls of the buss. The spring force thus applied by the buss is shared by the opposing walls of the buss; further, this spring force is being applied as a result of deflection of the corresponding opposing walls that are being deflected by the conductor and are deflecting as a result of deformation about a length of the wall extending from supporting buttresses positioned on either side of the conductor well. Since this deflection of the buss wall is occurring over a substantial length (the distance alpha shown in FIG. 2), the deformation of the wall material under load is held to a minimum to thereby avoid any permanent deformation or loss in "springing" force while the conductor is being inserted or being supported during use. The conductor well 41 also includes a flared entry 54 into the lower portion of the well past the lock to assist entry of the conductor into the lower portion of the well.

Referring now to FIGS. 4 through 7, a connector device constructed in accordance with the teachings of the present invention as shown. The device chosen for illustration incorporates three busses; it will be obvious to those skilled in the art that more or fewer busses may be used depending on the application and proposed use of the device. For example, the most prevalent use of the device of the present invention is as a three pole connector for connection to three conductors having typical sizes for residential and commercial applications. The housing for a typical three pole connector device constructed in accordance with the teachings of the present invention will normally be less than two inches long, one inch wide, and one half inch in height. The volume of the device is usually smaller than the equivalent number of wire nuts. Such applications normally utilize 12 gauge, 14 gauge, stranded or solid conductors. Typically the conductors are color coded for positive, neutral and ground poles. A three pole variation of the device of the present invention may be utilized with lighter gauge wires typical for lighting fixtures. Similarly, a five pole variation of the present invention may be utilized for incorporation in three-phase circuits found in commercial applications or various switch applications in both commercial and residential environments.

The device includes an enclosure or housing 60 of suitable insulating material such as plastic and the like, having a cover or top 61. The top is provided with a plurality of conductor well entry ports 63 which are aligned with and in registration with corresponding conductor wells provided in a plurality of busses supported within the housing. The housing 60 provides support for the respective busses 64, 65 and 66, including providing buttresses such as those shown at 69 and 70 and discussed in greater detail in connection with FIG. 1. Each of the entry ports 63 is provided with a corresponding raised wire guide 72 to facilitate the insertion of a wire or conductor into the corresponding conductor well. The top is also provided with a plurality of release port openings 74 each registering with a corresponding release port of the busses mounted within the closure. As noted previously, the embodiment chosen for illustration in FIG. 4 incorporates three busses; a lesser or greater number of busses may be included. Further, while the respective busses shown in FIGS. 1 and 4 each contain a plurality of conductor wells opening to the top of the device shown in FIG. 4, the enclosure may be provided with openings at the opposing ends 78 and 79 thereof in a like manner to accommodate conductor wells that may be positioned within each of the busses in the ends as well as the top of the device.

Figure 8:
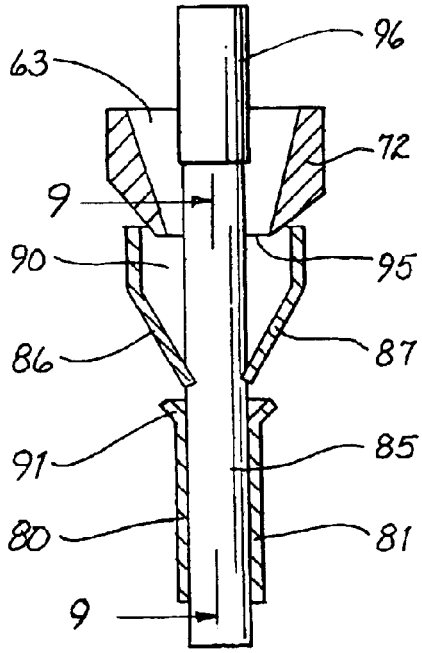
FIG. 8 is an enlarged cross-sectional view of a portion of a buss showing a conductor well and a well entry.

The housing will normally approximate the size of the equivalent number of wire nuts or other similar devices presently in use and will easily fit within the standard residential or commercial electrical junction boxes. In use, the housing is grasped by the operator and the bared ends of the conductors are inserted into the entry ports 63 in the top of the enclosure 61 and are guided by the raised wire guides 72 into the conductor well entry formed in the buss positioned beneath the entry port. Each of the busses corresponds to a different pole, and the ends of the stripped wires corresponding to any given pole are inserted into the connector to engage the buss corresponding to that pole. The bared end of the conductors extend downwardly through the opening in the top of the enclosure into the conductor well formed in the buss. As a conductor is inserted, the flared funnel-shaped entry formed in one edge of the buss guides the conductor into the well. The wire extends into the well, as best may be seen by reference to FIG. 8, so that the wire 85 forces the opposing walls 80 and 81 of the buss apart to provide intimate spring contact about the periphery of the wire throughout the length of the conductor well. The locking tabs 86 and 87 engage the surface of the conductor to prevent its inadvertent withdrawal. When the conductor being inserted is formed of braided wire, the individual surface wires of the conductor sometimes stray and can create difficulties, particularly if the stray strand contacts an unintended conductive surface (such as an adjacent wire). The funneled tapered entry port 63 in the lid of the housing gently forces the errand strand into contact with the main body of the braided conductor to prevent inadvertent contact with other surfaces. Similarly, the flared or funnel-shaped opening at the entry 90 to the conductor well and the flared entry 91 into the lower portion of the well insure that no individual strands of a braided conductor will come in contact with an unintended conductive surface.

The exit mouth 95 of the entry port 63 is wider than the conductor well but narrower than the flared or funnel-shaped opening 90 at the entry to the conductor well. In this manner, a stray wire strand may readily pass through the entry port 63 and is therefore captured within the housing 60; as the wire is further inserted into the connector, any such stray wire strands are thus insulated from contact with any conductive surface other than the buss to which the conductor is electrically connected. It may be noted that the wire insulation 96 extends into the entry port 63 but terminates before entering the entry 90 to the conductor well. In this way, any stray strands are captured within the connector and are prohibited from contacting other conductive surfaces.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. For use in an electrical junction box, a multi-pole electrical connector comprising:

(a) an insulating housing having a plurality if conductor ports therein, (b) a plurality of busses, electrically insulated from each other and mounted within said housing, each of said busses formed of two opposing walls of conductive material, each terminating at an edge, (c) a plurality of wells, each for receiving an electrical conductor, formed between said opposing walls, each of said wells extending from between said walls to an edge of said walls and positioned in registration with said conductor ports, (d) each of said wells having a flared portion at said edge, the flared portion of each well forming a funnel shaped opening into the respective well, and (e) each of said flared portions extending from an edge of said walls into a corresponding well and terminating within said well and including a pair of opposed locking tabs extending therefrom into said well for engaging an electrical conductor extending into said well.

2. The multi-pole electrical connector of claim 1 wherein each of said tabs includes an arcuate locking tip.

3. For use in an electrical junction box, a multi-pole electrical connector comprising:

(a) an insulating housing having a plurality if conductor ports therein, (b) a plurality of busses, electrically insulated from each other and mounted within said housing, each of said busses formed of a single sheet of conductive material formed into a U-shape to provide two opposing walls each terminating in an edge, (c) a plurality of wells, each for receiving an electrical conductor, formed between said opposing walls, each of said wells extending from between said walls to an edge of said walls and positioned in registration with said conductor ports, (d) each of said wells having a flared portion at said edge, the flared portion of each well forming a funnel shaped opening into the respective well, (e) each of said flared portions extending from an edge of said walls into a corresponding well and terminating within said well and including a pair of opposed locking tabs extending therefrom into said well for engaging an electrical conductor extending into said well.

4. The multi-pole electrical connector of claim 3, wherein each of said includes an arcuate locking tip.

5. An electrical buss for use in a multi-pole connector comprising:

(a) two opposing walls formed of conductive material, each terminating at an edge, (b) a plurality of wells, each for receiving an electrical conductor, formed between said opposing walls, each of said wells extending from between said walls to an edge of said walls, (c) each of said wells having a flared portion at said edge, the flared portion of each well forming a funnel shaped opening into the respective well, (d) each of said flared portions extending from an edge of said walls into a corresponding well and terminating within said well a pair of opposed locking tabs extending therefrom into said well for engaging an electrical conductor extending into said well.

6. The electrical buss of claim 5 wherein each of said tabs includes an arcuate locking tip.

7. An electrical buss for use in a multi-pole connector comprising:

(a) a single sheet of conductive material formed into U-shape to provide two opposing walls each terminating at an edge, (b) a plurality of wells, each for receiving an electrical conductor, formed between said opposing walls, each of said wells extending from between said walls to an edge of said walls, (c) each of said wells having a flared portion at said edge, the flared portion of each well forming a funnel shaped opening into the respective well, (d) each of said flared portions extending from an edge of said walls into a corresponding well and terminating within said well and including a pair of opposed locking tabs extending therefrom into said well for engaging an electrical conductor extending into said well.

8. The electrical buss of claim 7, wherein each of said tabs includes an arcuate locking tip.

* * * * *